US010158196B2

(12) United States Patent
Fujii et al.

(10) Patent No.: US 10,158,196 B2
(45) Date of Patent: Dec. 18, 2018

(54) CONNECTOR

(71) Applicant: Sumitomo Wiring Systems, Ltd., Yokkaichi, Mie (JP)

(72) Inventors: Masayasu Fujii, Mie (JP); Toshikazu Sakurai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/568,808

(22) PCT Filed: Apr. 4, 2016

(86) PCT No.: PCT/JP2016/060981
§ 371 (c)(1),
(2) Date: Oct. 24, 2017

(87) PCT Pub. No.: WO2016/170956
PCT Pub. Date: Oct. 27, 2016

(65) Prior Publication Data

US 2018/0115110 A1 Apr. 26, 2018

(30) Foreign Application Priority Data

Apr. 24, 2015 (JP) ..... 2015-089125

(51) Int. Cl.
*H01R 13/64* (2006.01)
*H01R 13/11* (2006.01)
(Continued)

(52) U.S. Cl.
CPC ..... *H01R 13/64* (2013.01); *H01R 13/11* (2013.01); *H01R 13/113* (2013.01); *H01R 13/506* (2013.01); *H01R 13/639* (2013.01)

(58) Field of Classification Search
CPC ..... H01R 2107/00; H01R 13/639; H01R 13/6683; H01R 24/58; H01R 2201/12;
(Continued)

(56) References Cited

U.S. PATENT DOCUMENTS 5,743,760 A * 4/1998 Inaba ..... H01R 13/6272 439/489
6,171,124 B1 * 1/2001 Kojima ..... H01R 13/7032 200/51.1

(Continued)

FOREIGN PATENT DOCUMENTS

| | | |
|---|---|---|
| JP | 8-153553 | 6/1996 |
| JP | 2013-109897 | 6/2013 |
| JP | 2013-175326 | 9/2013 |

OTHER PUBLICATIONS

International Search Report dated Jun. 21, 2016

*Primary Examiner* — Truc Nguyen
(74) *Attorney, Agent, or Firm* — Gerald E. Hespos; Michael J. Porco; Matthew T. Hespos

(57) ABSTRACT

A connector includes a first housing (10) with two detection terminals (13), a resilient deflecting portion (37) in a second housing (30), a shorting terminal fitting (60) in the second housing (30), wiping portions (68) integrally formed to the shorting terminal fitting (60) and configured such that the detection terminals (13) slide in contact therewith in the process of connecting the first and second housings (10, 30), and a resilient contact piece (62) integrally formed to the shorting terminal fitting (60) and configured to be resiliently displaced to a retracted position, where the resilient contact piece is not in contact with the detection terminals (13), as the resilient deflecting portion (37) is resiliently deflected and resiliently return to a short-circuit position, where the resilient contact piece contacts the detection terminals (13), and short the detection terminals (13) as the resilient deflecting portion (37) resiliently turns.

10 Claims, 9 Drawing Sheets

(51) Int. Cl.
*H01R 13/639* (2006.01)
*H01R 13/506* (2006.01)

(58) Field of Classification Search
CPC .... H01R 24/60; H01R 13/6275; H01R 13/64; H01R 13/641; H01R 13/6581; H01R 13/6691; H01R 2103/00; H01R 13/642; H01R 13/7175
See application file for complete search history.

(56) References Cited

U.S. PATENT DOCUMENTS

| | | | | |
|---|---|---|---|---|
| 6,186,805 | B1 * | 2/2001 | Krishnaswamy .. | H01R 13/7032 200/51.1 |
| 8,393,921 | B1 * | 3/2013 | Chiu ..... | H01R 13/7033 439/660 |
| 8,764,496 | B2 | 7/2014 | Todo et al. | |
| 2007/0082549 | A1 * | 4/2007 | Fujii ..... | H01R 13/62938 439/595 |
| 2007/0149041 | A1 * | 6/2007 | Fujii ..... | H01R 13/641 439/489 |
| 2013/0130539 | A1 | 5/2013 | Segawa | |
| 2015/0140853 | A1 * | 5/2015 | Hashimoto ..... | H01R 13/641 439/354 |

* cited by examiner

CONNECTOR

BACKGROUND

Field of the Invention

The present invention relates to a connector.

Description of the Related Art

Japanese Unexamined Patent Publication No. 2013-109897 discloses a connector with a connection detection means for detecting whether or not a first housing and a second housing have been connected properly. The first housing is provided with a pair of detection terminals. A lever is mounted on the second housing and can be rotated from an initial position to a connection position for connecting the two housings. Further, a detection unit is mounted in the second housing for releasing a short circuit between the pair of detection terminals when the two housings are connected incompletely and shorting the pair of detection terminals when the two housings are connected properly. The detection unit is composed of a shorting terminal including two resilient arms and two intermediate terminals to be connected to the detection terminals.

A resilient deflecting portion is formed in the second housing and is deformed resiliently in the process of rotating the lever from the initial position to the connection position (i.e. in a state where the two housings are incompletely connected) due to interference with the lever. As a result, the resilient arms are pressed by the resilient deflecting portion and are separated from the intermediate terminals. In this state, the detection terminals are not shorted even if the detection terminals are connected to the intermediate terminals, and it is detected that the two housings are in an incompletely connected state.

When the lever reaches the connection position and the two housings are connected properly, the resilient deflecting portion released from the interference with the lever resiliently returns at once. As the resilient deflecting portion resiliently returns, the resilient arms resiliently return at once and are connected to the intermediate terminals. Thus, the detection terminals are shorted. In this way, it is detected that the two housings have been connected properly.

The detection terminals of this connector resiliently slide in contact with resilient contact pieces formed on the intermediate terminals when the detection terminals are connected to the intermediate terminals. This sliding contact removes any external matter that may have adhered to the detection terminals before the two housings are connected. Thus, there is no possibility of impairing a connection detection function due to the adhesion of external matter to the detection terminals.

The above-described connector has a problem of having many components since the detection unit is composed of the shorting terminal and the two detection terminals. The present invention was completed based on this situation and aims to reduce the number of components

SUMMARY

The invention is directed to a connector with a first housing including two detection terminals and a second housing connectable to the first housing. A resilient deflecting portion is formed in the second housing. The resilient deflecting portion is configured to be deflected resiliently in the process of connecting the first and second housings and resiliently returns when the first and second housings are connected properly. A shorting terminal fitting is provided in the second housing, and a wiping portion is formed integrally to the shorting terminal fitting. The wiping portion is configured such that the detection terminals slide in contact with the wiping portion in the process of connecting the first and second housings. A resilient contact piece is formed integrally to the shorting terminal fitting and is configured to be displaced resiliently to a retracted position, where the resilient contact piece is not in contact with the pair of detection terminals as the resilient deflecting portion is deflected resiliently. The resilient contact piece then resiliently returns to a short-circuit position where the resilient contact piece is in contact with the detection terminals, and shorts the detection terminals as the resilient deflecting portion resiliently returns.

According to this configuration, in the connecting process of the two housings, even if external matter adheres to the detection terminals, the external matter is removed by the wiping portion. Thus, the external matter can be prevented from being caught between the detection terminals and the resilient contact piece. The wiping portion and the resilient contact piece are formed integrally to the shorting terminal fitting. Thus, the number of components can be reduced as compared to the case where the wiping portion and the resilient contact piece are separate components.

The connector may include a wiping portion insulating layer provided on the detection terminal and configured to be interposed between the detection terminal and the wiping portion immediately before the first and second housings are connected properly. According to this configuration, the detection terminals are not shorted via the wiping portion. Thus, whether or not the two housings have been properly connected can be detected reliably.

The detection terminals may extend straight and parallel to a connecting direction of the first and second housings. The detection terminals are provided with a wiping portion side extension layer formed by extending the wiping portion insulating layer toward base end sides of the detection terminals. A wiping portion side positioning rib is formed at an opening in a front surface of the second housing through which the detection terminals are inserted and is configured to position the detection terminals by causing the wiping portion insulating layer and the wiping portion side extension layer to slide in contact therewith. According to this configuration, a contact state of the resilient contact piece and the detection terminals is stabilized by positioning the detection terminals.

The detection terminals may be united via a coupling portion made of synthetic resin. The wiping portion insulating layer may be connected to the coupling portion and may be continuous over the detection terminals. According to this configuration, a mutual positional relationship of the detection terminals is stabilized.

A covering portion may be formed integrally to the shorting terminal fitting and may be configured to cover contact points of the resilient contact piece with the detection terminals in a state where the first and second housings are not connected yet. According to this configuration, the adhesion of external matter to the contact points of the resilient contact piece can be prevented.

The contact points may resiliently contact the covering portion in the state where the first and second housings are not connected yet. According to this configuration, the adhesion of external matter to the contact points of the resilient contact piece can be provided more reliably.

A covering portion insulating layer may be provided on the detection terminal and may be configured to be interposed between the detection terminal and the covering portion immediately before the first and second housings are connected properly connected. According to this configuration, the detection terminals are not shorted via the covering portion. Thus, whether or not the two housings have been connected properly can be detected reliably.

The detection terminals may extend straight in parallel to a connecting direction of the first and second housings. The detection terminals may be provided with a covering portion side extension layer formed by extending the covering portion insulating layer toward base end sides of the detection terminals. A covering portion side positioning rib may be formed at an opening in a front surface of the second housing through which the detection terminals are inserted and may be configured to position the detection terminals by causing the covering portion insulating layer and the covering portion side extension layer to slide in contact therewith. According to this configuration, the contact state of the resilient contact piece and the detection terminals is stabilized by positioning the detection terminals.

The detection terminals may be united via a coupling portion made of synthetic resin, and the covering portion insulating layer is connected to the coupling portion and continuous over the detection terminals. According to this configuration, the mutual positional relationship of the detection terminals is stabilized.

DETAILED DESCRIPTION

Figure 1:
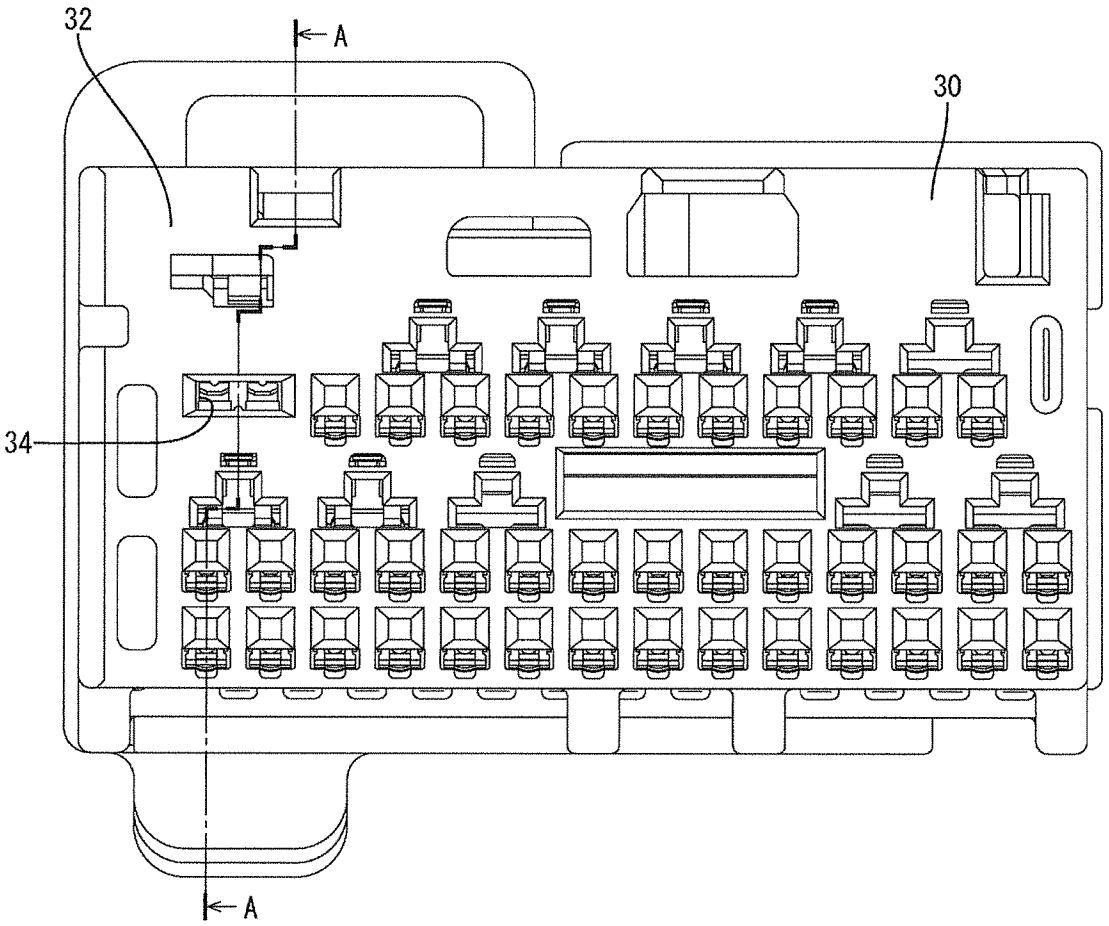
FIG. 1 is a front view of a second housing of one embodiment.

One specific embodiment of the invention is described with reference to FIGS. 1 to 9. A connector of this embodiment includes a first housing 10, two detection terminals 13, a second housing 30, a lever 50 and a shorting terminal fitting 60. The connector has a connection detection function for detecting a connected state of the two housings 10, 30 based on whether or not the detection terminals 13 constituting a detection circuit (not shown) are shorted.

Note that, in the following description, a direction substantially parallel to connecting and separating directions of the first and second housings 10, 30 is referred to as a front-rear direction. It is assumed that the first and second housings 10, 30 are connected such that front surfaces thereof face each other. Thus, a front side in the first housing 10 and a front side in the second housing 30 are opposite. Further, upper and lower sides shown in FIGS. 1, 2 and 4 to 7 are directly defined as upper and lower sides.

<First Housing 10>

The first housing 10 is made of an insulating material (synthetic resin material) and includes, as shown in FIGS. 4 to 7, a terminal holding portion 11 and a tubular receptacle 12 extending forward from the outer peripheral edge of the terminal holding portion 11. The tab-like detection terminals 13 are long and narrow in the front-rear direction and are bilaterally symmetrical. The detection terminals 13 are mounted in the terminal holding portion 11 while being insulated from each other. The detection terminals 13 are arranged side by side in a lateral direction (direction intersecting with the connecting direction of the two housings 10, 30). The detection terminals 13 have a plate thickness direction oriented in a vertical direction. A length direction of the detection terminals 13 is parallel to the connecting direction of the housings 10, 30.

Front end areas of the detection terminals 13 project forward from the front surface of the terminal holding portion 11 and are surrounded by the receptacle 12. Areas of the detection terminals 13 projecting forward from the terminal holding portion 11 serve as projecting portions 14 extending straight in parallel to the connecting direction of the two housings 10, 30. In the projecting portions 14, a coupling 15 (see FIG. 8) extending from the front surface of the terminal holding portion 11, left and right outer side surface layers 16 (see FIG. 8), a wiping portion insulating layer 17 (see FIGS. 4 to 8), a wiping portion side extension layer 18 (see FIGS. 4 to 8), a covering portion insulating layer 19 (see FIGS. 4 to 8) and a covering portion side extension layer 20 (see FIGS. 4 to 8) are held in close contact with the detection terminals 13 by insert molding.

The coupling 15 extends over the entire length of the projecting portions 14 and is disposed to be sandwiched between the pair of projecting portions 14. The coupling 15 is held in close contact with inner side surfaces of the projecting portions 14 to unite the projecting portions 14. The outer side surface layers 16 are disposed over the entire length of the projecting portions 14 and held in close contact with outer side surfaces of the projecting portions 14. A formation area of the couplin 15 and the outer side surface layers 16 in the vertical direction (plate thickness direction of the detection terminals 13) is the same range as the plate thickness of the detection terminals 13.

The wiping portion insulating layer 17 is disposed in a central area in a length direction of the projecting portions 14. The wiping portion insulating layer 17 is connected to the lower surface of the coupling 15, extends to both left and right sides from the coupling 15 and is held in close contact with the lower surfaces of the projecting portions 14. Both left and right side edge parts of the wiping portion insulating layer 17 are connected to the lower surfaces of the outer side surface layers 16.

The wiping portion side extension layer 18 extends rearward from the wiping portion insulating layer 17 and is connected to the front surface of the terminal holding portion 11. Similarly to the wiping portion insulating layer 17, the wiping portion side extension layer 18 is connected to the lower surface of the coupling 15, extends to both left and right sides from the coupling 15 and is held in close contact with the lower surfaces of the projecting portions 14. Both left and right side edge parts of the wiping portion side extension layer 18 are connected to the lower surfaces of the outer side surface layers 16.

The covering portion insulating layer 19 is disposed on projecting end parts of the projecting portions 14. The covering portion insulating layer 19 is connected to the upper surface of the coupling 15, extends to both left and right side from the coupling 15 and is held in close contact with the upper surfaces (i.e. surfaces opposite to contact surfaces 21) of the projecting portions 14. Further, both left and right side edge parts of the covering portion insulating layer 19 are connected to the upper surfaces of the outer side surface layers 16.

The covering portion side extension layer 20 extends rearward from the covering portion insulating layer 19 and is connected to the front surface of the terminal holding portion 11. Similarly to the covering portion insulating layer 19, the covering portion side extension layer 20 is connected to the upper surface of the coupling 15, extends to both left and right sides from the coupling 15 and is held in close contact with the upper surfaces of the pair of projecting portions 14. Both left and right side edge parts of the covering portion side extension layer 20 are connected to the upper surfaces of the outer side surface layers 16.

Areas of the projecting portions 14 from the front end of the wiping portion insulating layer 17 to the front end surface of the terminal holding portion 11 are covered up over the entire peripheries by the coupling 15, the pair of outer side surface layers 16, the wiping portion insulating layer 17, the wiping portion side extension layer 18 and the covering portion extension layer 20. Further, areas of the projecting portions 14 from the front end of the wiping portion insulating layer 17 to the projecting ends have upper surfaces and both left and right side surfaces covered by the coupling 15, the outer side surface layers 16, the covering portion insulating layer 19 and the covering portion side extension layer 20.

Projecting end areas of the lower surfaces of the projecting portions 14 (detection terminals 13) from the front end of the wiping portion insulating layer 17 to the projecting ends serve as the exposed contact surfaces 21. These contact surfaces 21 can slide in contact with wiping portions 68 and contact points 65 of a resilient contact piece 62 to be described later. Since the contact surfaces 21 are exposed, external matter can adhere to the contact surfaces 21 in a state before the two housings 10, 30 are connected (in a state where the two housings 10, 30 are separated).

The detection circuit (not shown) detects whether or not the two housings 10, 30 are connected properly based on whether or not the pair of detection terminals 13 are shorted (electrically connected) during a period until the two housings 10, 30 are connected properly from a final stage of the connection in the process of connecting the two housings 10, 30. That is, in the detection circuit, it is determined that the two housings 10, 30 have been connected properly if a short circuit between the detection terminals 13 is detected, and it is determined that the two housings 10, 30 are in an incompletely connected state (being connected and not properly connected yet) if the detection terminals 13 are not shorted.

<Second Housing 30>

Figure 2:
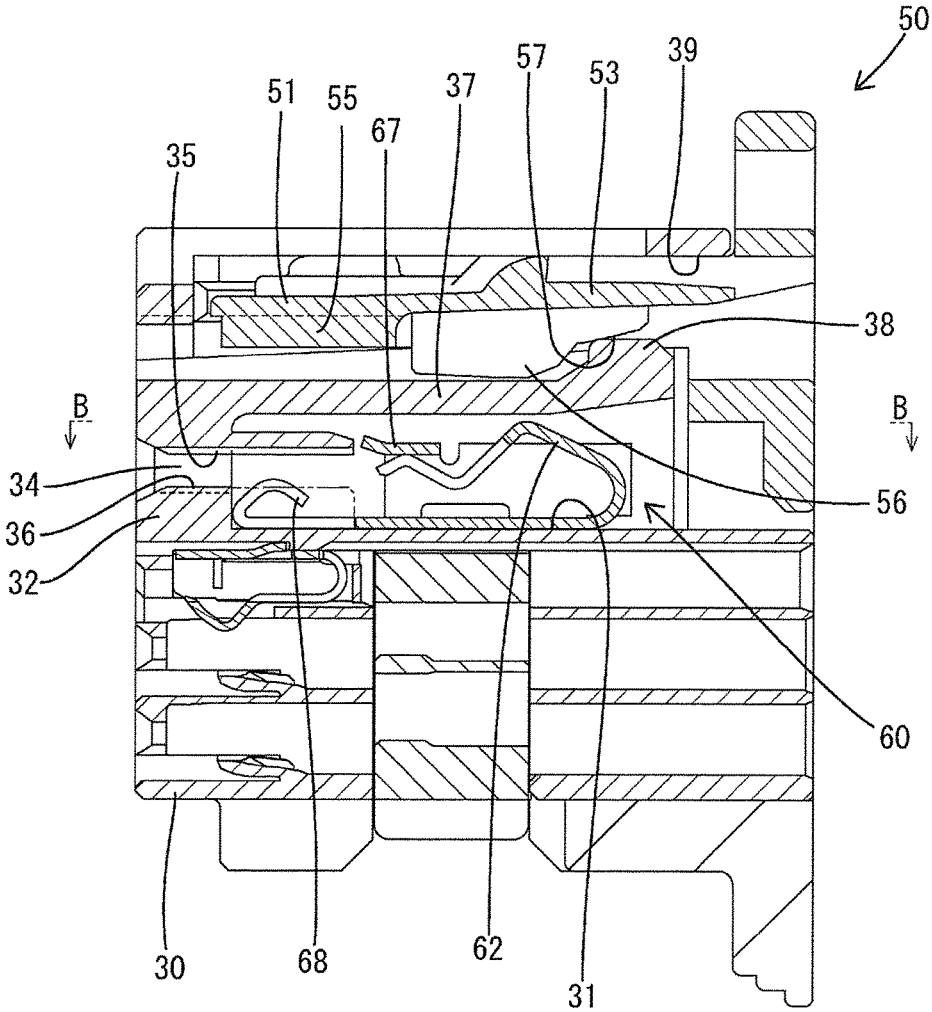
FIG. 2 is a section along A-A of FIG. 1.
Figure 3:
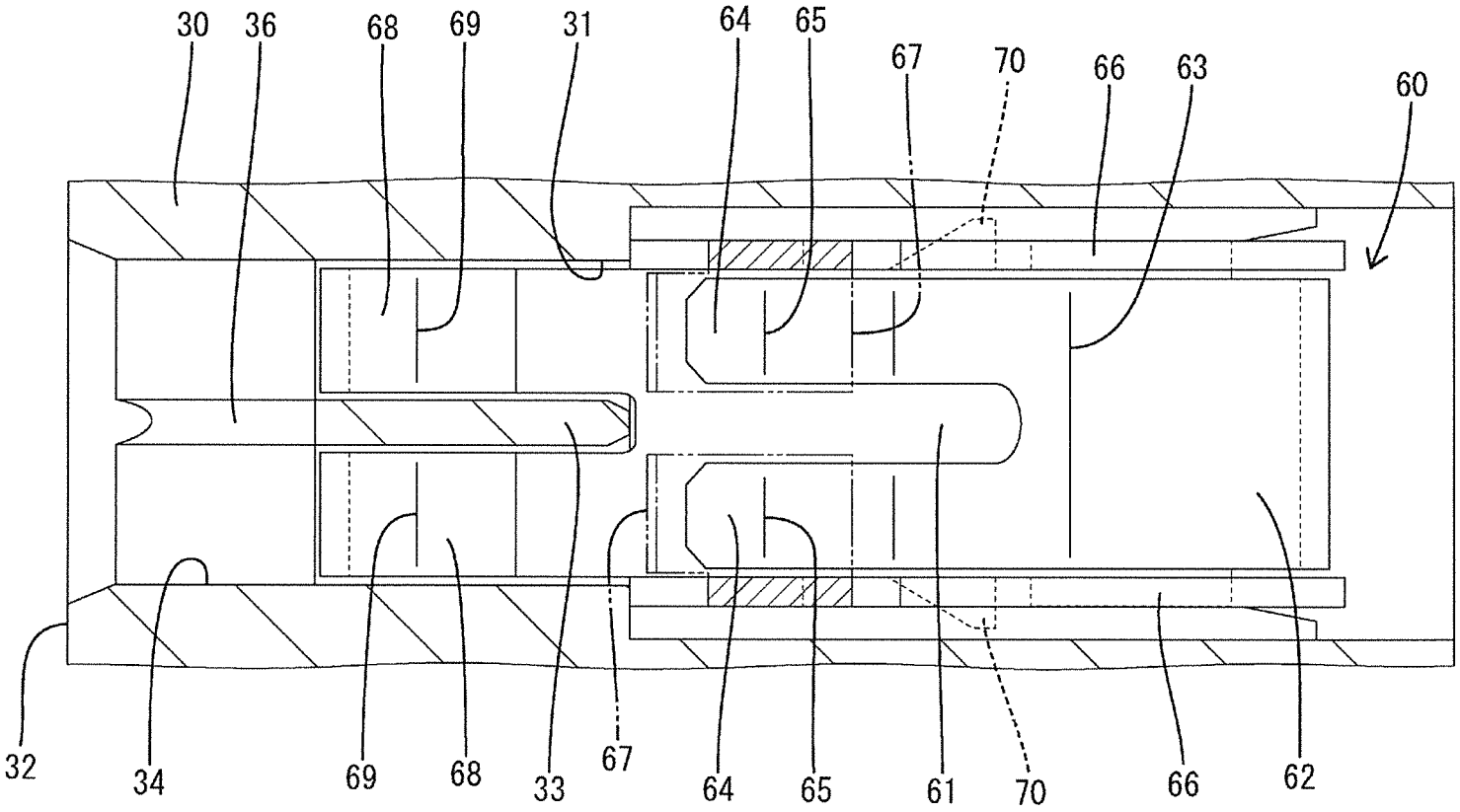
FIG. 3 is a section along B-B of FIG. 2.

The second housing 30 is made of an insulating material (synthetic resin material). As shown in FIGS. 2 to 7, a terminal accommodating chamber 31 is formed inside the second housing 30. The shorting terminal fitting 60 is inserted into the terminal accommodating chamber 31 through a terminal insertion opening on the rear end of the terminal accommodating chamber 31. As shown in FIG. 3, a partition wall 33 extending rearward from a front surface wall 32 of the second housing 30 is formed in the terminal accommodating chamber 31. As shown in FIGS. 1 to 3, an entrance opening 34 allowing the front end of the terminal accommodating chamber 31 to communicate with the front end surface of the second housing 20 is formed in the front surface wall 32. The entrance opening 34 has a substantially rectangular shape longer in the lateral direction than in the vertical direction.

Figure 8:
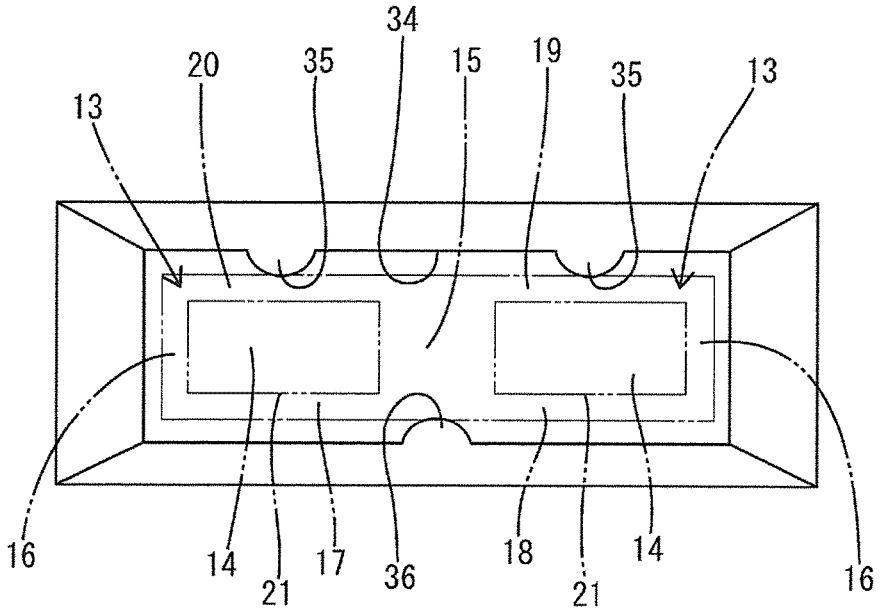
FIG. 8 is a partial enlarged view showing the shape of an entrance opening of the second housing.

The detection terminals 13 are inserted collectively into the entrance opening 34 in the process of connecting the two housings 10, 30. As shown in FIG. 8, two bilaterally symmetrical covering portion side positioning ribs 35 project from the inner periphery upper surface of the entrance opening 34. A wiping portion side positioning rib 36 projects from a widthwise center position on the inner periphery lower surface of the entrance opening 34.

As shown in FIGS. 2 and 4 to 7, the second housing 30 is formed with a resilient deflecting portion 37 which is resiliently deflected in the process of connection to the first housing 10. The resilient deflecting portion 37 constitutes an upper wall of the terminal accommodating chamber 31, and is cantilevered rearward while facing the terminal accommodating chamber 31. An upward projection 38 is formed on a rear end part of the resilient deflecting portion 37. The lower surface of the resilient deflecting portion 37 serves as a pressing surface for resiliently deflecting the resilient contact piece 62 to be described later down.

Figure 4:
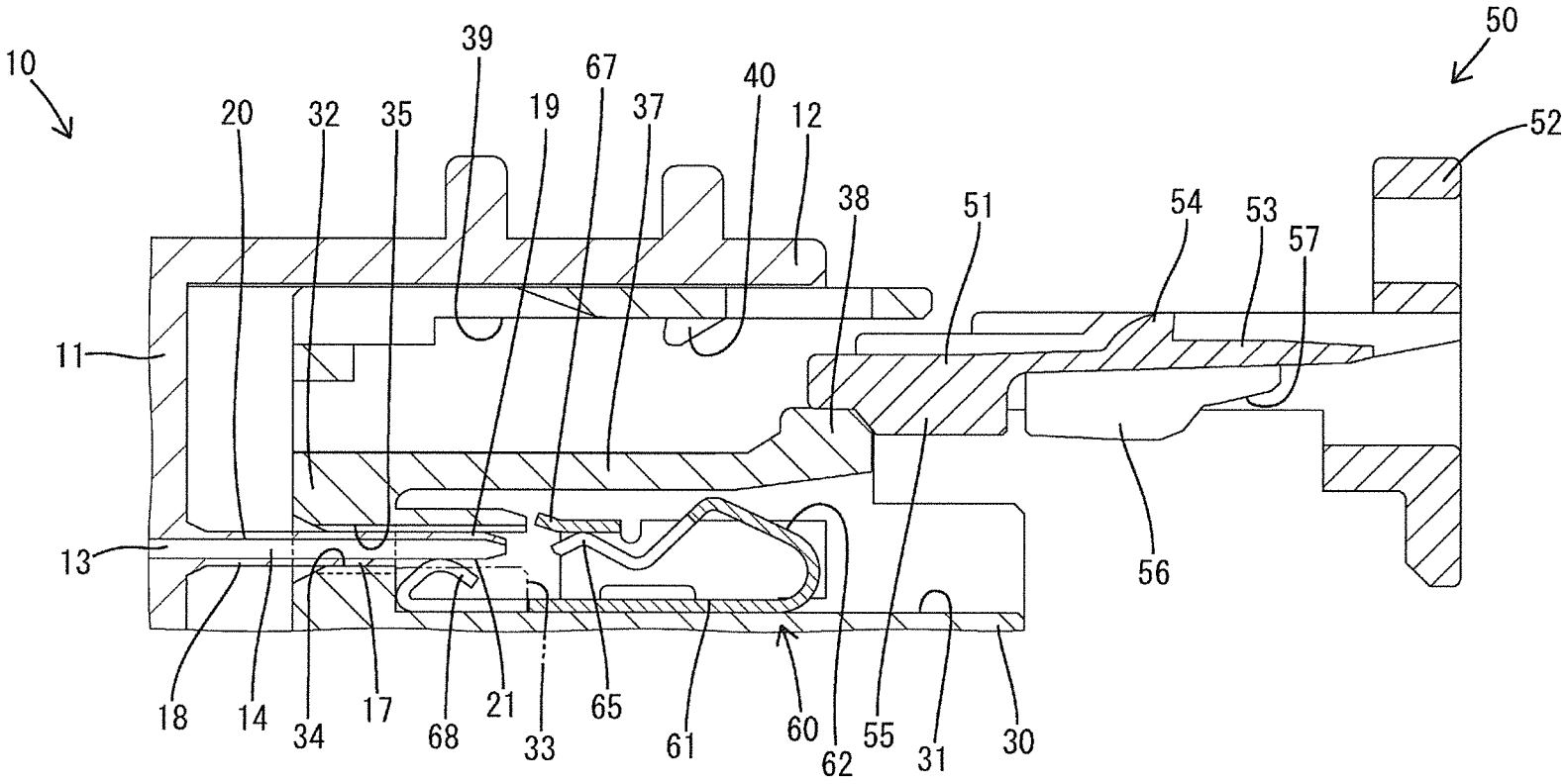
FIG. 4 is a side view in section showing a state where the connection of a first housing and the second housing is started.
Figure 5:
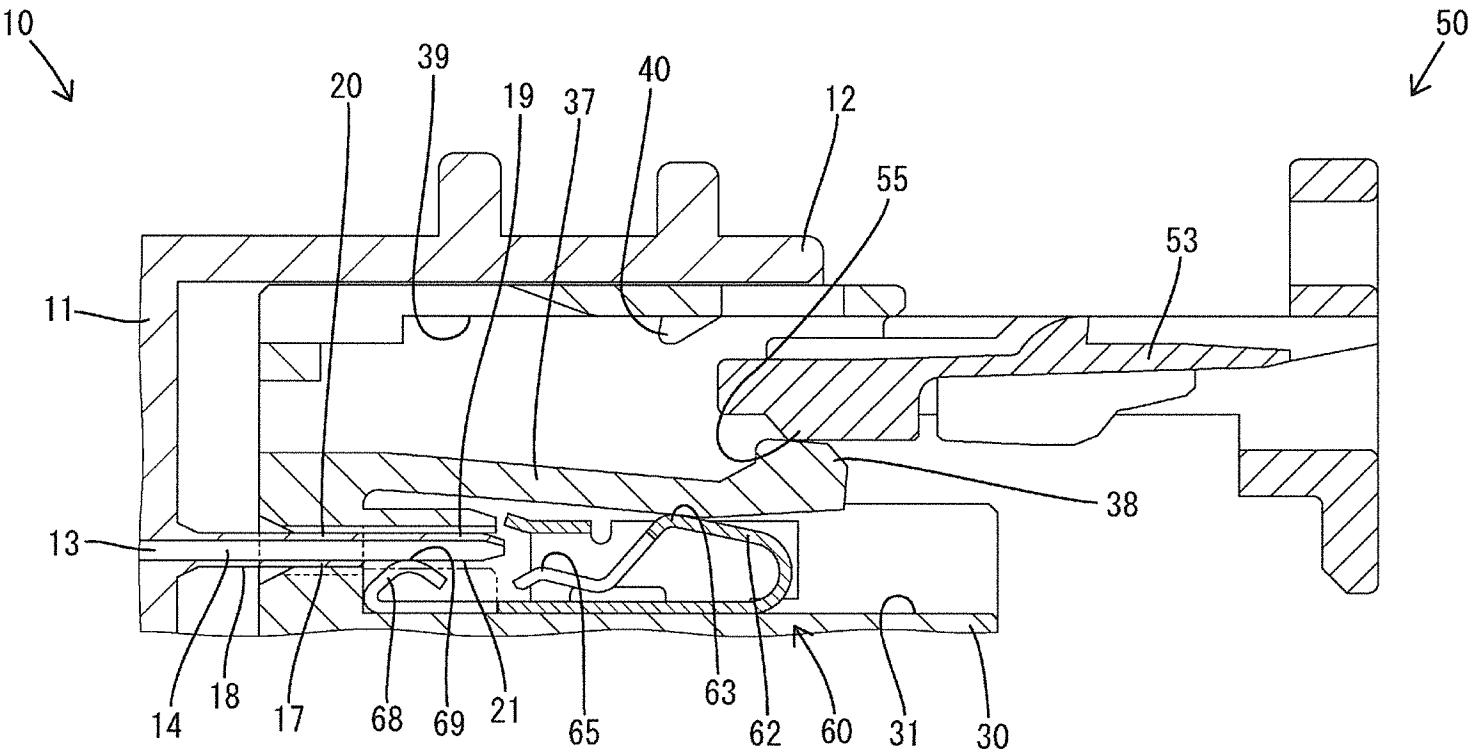
FIG. 5 is a side view in section showing a state where a detection terminal slides in contact with a wiping portion in the process of connecting the first and second housings.
Figure 6:
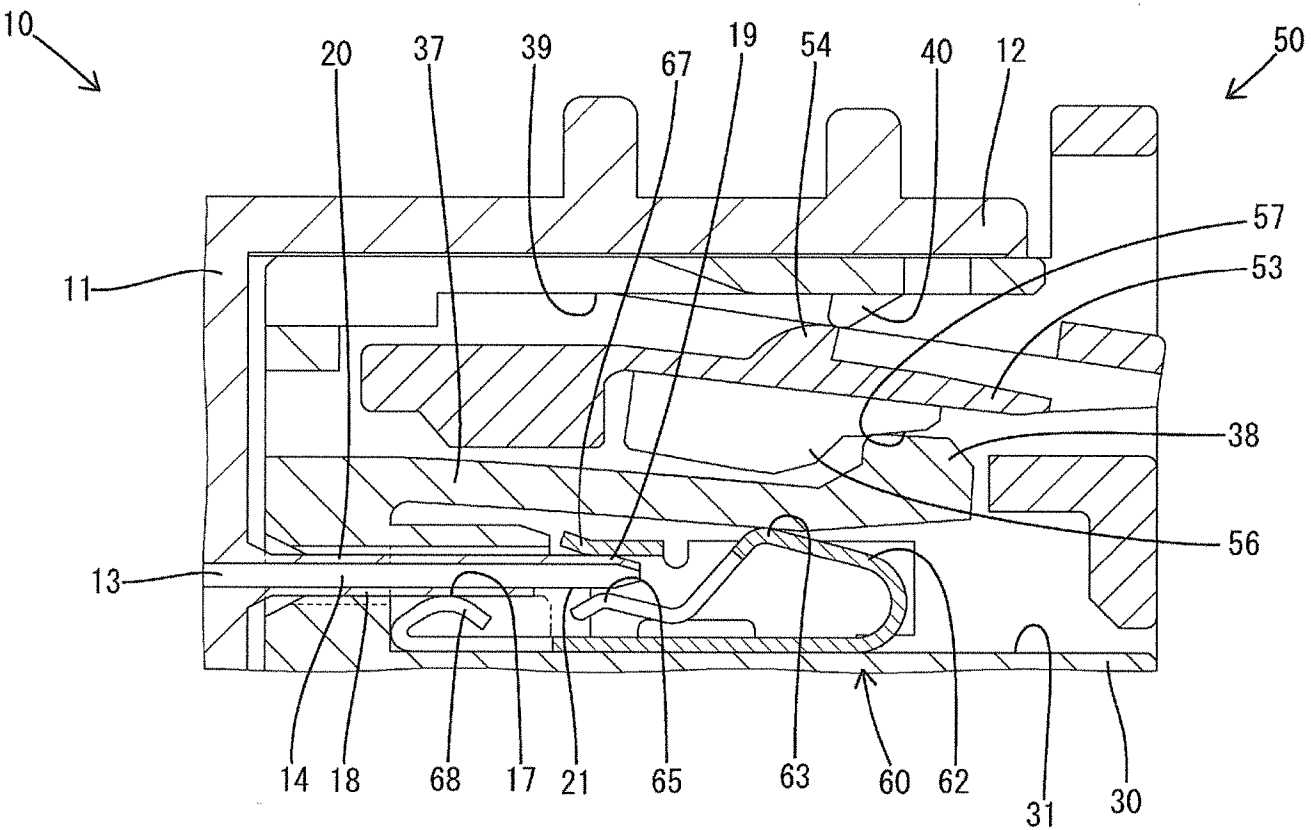
FIG. 6 is a side view in section showing a state immediately before the first and second housings are properly connected.
Figure 7:
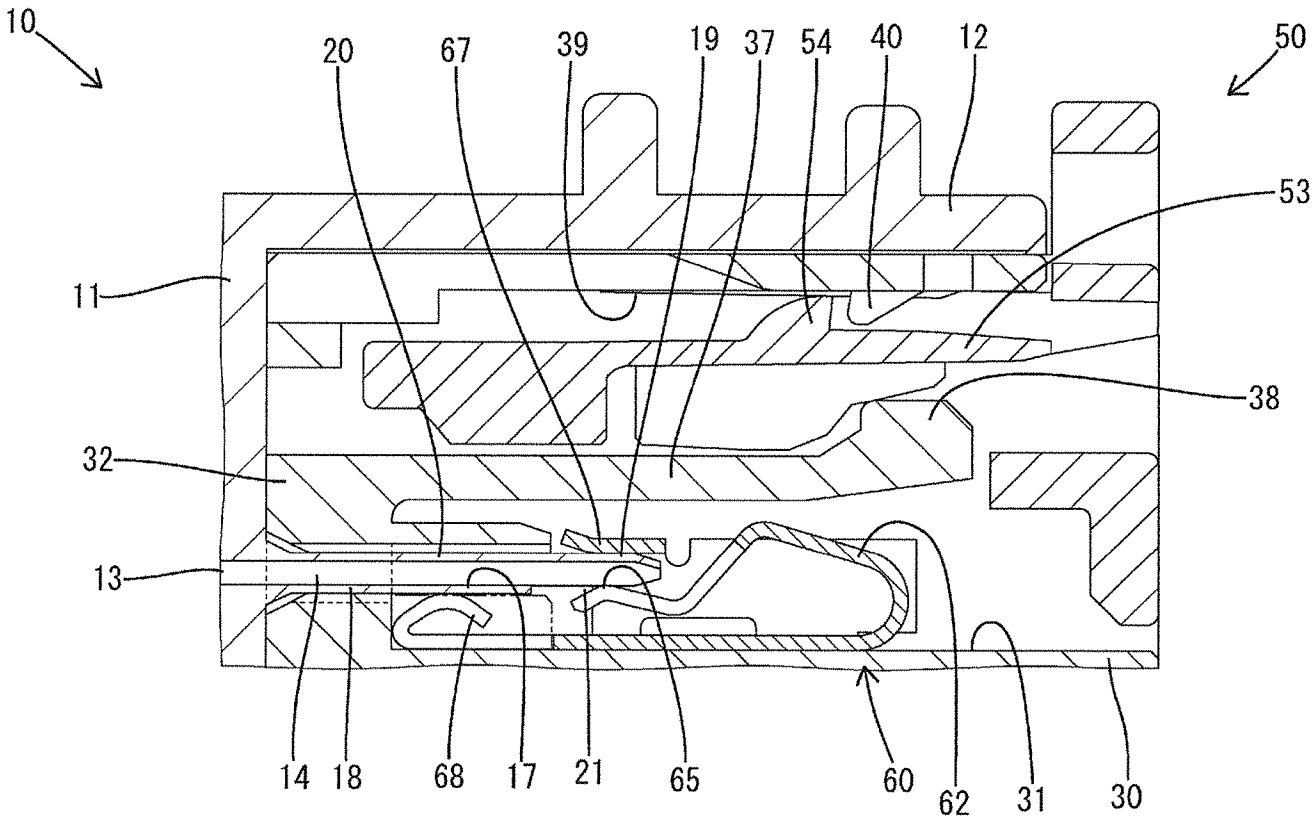
FIG. 7 is a side view in section showing a state where the first and second housings are properly connected.

The resilient deflecting portion 37 normally is held at a standby position as shown in FIGS. 2, 4 and 7, but is displaceable to an operating position below while obliquely changing the posture thereof with a front end part (base end part) of the resilient deflecting portion 37 as a support as shown in FIGS. 5 and 6 when receiving a pressing force from above. When the resilient deflecting portion 37 is displaced to the operating position, the rear end part thereof enters the terminal accommodating chamber 31. The second housing 30 is formed with an accommodation space 39 for accommodating the lever 50 in the form of a single plate, and the accommodation space 39 is located above the terminal accommodating chamber 31. The upper surface (projection 38) of the resilient deflecting portion 37 is directly facing this accommodation space 39. A locking portion 40 in the form of a projection to be locked to a lock projection 54 of the lever 50 when the two housings 10, 30 are connected properly is formed on the ceiling surface of the accommodation space 39.

<Lever 50>

The lever 50 is made of synthetic resin and mounted on the second housing 30 to be rotatable in a horizontal direction about a vertically extending support shaft (not shown). The lever 50 is rotationally displaced between an initial position (see FIG. 4) and a connection position (see FIG. 7). As shown in FIGS. 4 to 7, the lever 50 includes a substantially horizontal plate 51, an operating portion 52 formed on a rear end part of the plate 51 and a lock arm 53 cantilevered rearward (toward the operating portion 52) from the front end of the plate 51. As shown in FIG. 4, when the lever 50 is at the initial position, only front end parts of the plate 51 and the lock arm 53 are accommodated in the accommodation space 39. Further, as shown in FIG. 7, when the lever 50 is moved to the connection position, the entire plate 51 and the entire lock arm 53 are accommodated in the accommodation space 39.

The lock arm 53 locks the two housings 10, 30 in the connected state by being locked to the locking portion 40 of the first housing 10 when the second housing 30 is connected properly to the first housing 10. The lock arm 53 is normally held at a locking position as shown in FIGS. 2, 4 and 5, but is resiliently deflected to an unlocking position below while obliquely changing the posture thereof with the front end part (base end part) of the lock arm 53 as a supporting point as shown in FIG. 6 when receiving a pressing force from above. The lock projection 54 is formed on the upper surface of the lock arm 53.

Further, a first pressing portion 55 in the form of a projection for operating the resilient contact piece 62 via the resilient deflecting portion 37 is formed on the lower surface (surface facing the upper surface of the resilient deflecting portion 37) of a front end part of the plate 51. A second pressing portion 56 in the form of a projection for operating the resilient contact piece 62 via the resilient deflecting portion 37 is formed on the lower surface (surface facing the upper surface of the resilient deflecting portion 37) of the lock arm 53. A rear end part of the second pressing portion 56 is recessed (cut) to retract upwardly, thereby forming an escaping portion 57.

<Shorting Terminal Fitting 60>

Figure 9:
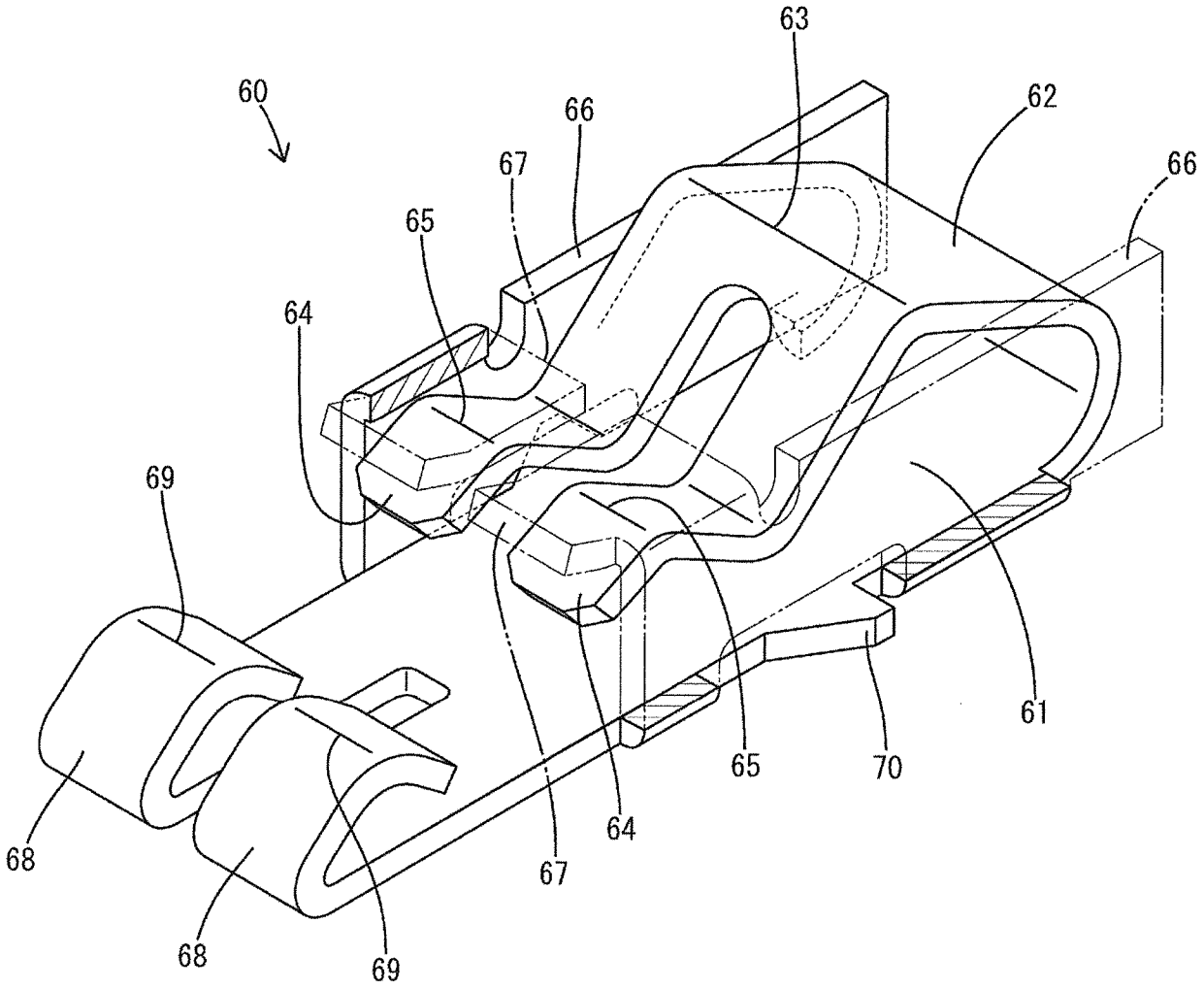
FIG. 9 is a perspective view partly in section of a shorting terminal fitting.

The connection detection function of the connector is realized by the detection terminals 13, the resilient deflecting portion 37, the lock arm 53 and the shorting terminal fitting 60 described above. The structure of the shorting terminal fitting 60 is described below. The shorting terminal fitting 60 is formed into a shape long in the front-rear direction by applying bending and the like to a metal plate material stamped into a predetermined shape, and is a single component as shown in FIG. 9. The shorting terminal fitting 60 includes a base plate 61 in the form of a flat plate, the resilient contact piece 62, two bilaterally symmetrical covering portions 67 and two bilaterally symmetrical wiping portions 68. The resilient contact piece 62 is cantilevered while being folded toward a front-upper side from the rear end edge of the base plate 61.

The resilient contact piece 62 is resiliently deflectable in the vertical direction (direction intersecting with the connecting direction of the two housings 10, 30) with a rear end part thereof as a supporting point. The resilient contact piece 62 is formed with a pressure receiving portion 63 bent into a chevron shape projecting upward. Two forked and bilaterally symmetrical arms 64 are formed on an extending end part of the resilient contact piece 62. Each arm 64 is bent into a chevron shape, and the top of this bent part serves as the contact point 65 capable of contacting the detection terminal 13 and the covering portion 67.

Two bilaterally symmetrical side walls 66 rise from left and right side edges of the base plate 61. The bilaterally symmetrical covering portions 67 extend parallel to the base plate 61 from the rising end edges of the both side walls 66. When the two housings 10, 30 are not connected yet and the resilient contact piece 62 is in a free state without receiving an external force, the contact points 65 are resiliently in contact with the lower surfaces of the covering portions 67 by a resilient force of the resilient contact piece 62.

The wiping portions 68 are cantilevered while being folded to a rear-upper side from a forked front end part of the base plate 61. The wiping portion 68 is formed with a sliding contact portion 69 bent into a chevron shape projecting upward. The wiping portion 68 is resiliently deflectable in the vertical direction (direction intersecting with an inserting direction of the detection terminals 13 into the terminal accommodating chamber 31) with a front end part thereof as a support.

Bilaterally symmetrical retaining projections 70 are formed on both left and right side edge parts of the base plate 61. With the shorting terminal fitting 60 accommodated in the terminal accommodating chamber 31, the retaining projections 70 bite into left and right inner side walls of the terminal accommodating chamber 31 for locking to fix and retain the shorting terminal fitting 60. Further, with the shorting terminal fitting 60 mounted in the terminal accommodating chamber 31, the partition wall 33 is located between the wiping portions 68. In this way, the shorting terminal fitting 60 is positioned in the lateral direction in the terminal accommodating chamber 31.

In a state before the two housings 10, 30 are connected, the lever 50 is held at the initial position (see FIG. 4). In this state, since the lock arm 53 is retracted rearwardly of the resilient deflecting portion 37, the resilient deflecting portion 37 is held at the standby position (free state) and not in contact with the resilient contact piece 62. Thus, the resilient contact piece 62 is held in a state where the contact points 65 thereof are resiliently in contact with the covering portions 67. Since the contact points 65 are directly resiliently in contact with the covering portions 67, there is no possibility that external matter adheres to the contact points 65.

When the two housings 10, 30 in a separated state are connected shallowly, the projecting portions 14 (tip portions) of the pair of detection terminals 13 are inserted into the terminal accommodating chamber 31 through the entrance opening 34. In the process of inserting the detection terminals 13 through the entrance opening 34, the upper surface of the covering portion side extension layer 20 slides in contact with the covering portion side positioning ribs 35 and the lower surface of the wiping portion side extension layer 18 slides in contact with the wiping portion side positioning rib 36, whereby the detection terminals 13 (projecting portions 14) are positioned in the vertical direction.

As the detection terminals 13 are inserted into the entrance opening 34, the contact surfaces 21 of the detection terminals 13 and the sliding contact portions 69 of the wiping portions 68 resiliently slide in contact with each other due to resilient forces of the wiping portions 68. Thus, even if external matters adhere to the contact surfaces 21, the external matter is wiped off from the contact surfaces 21 by the sliding contacts 69.

If the lever 50 is rotated in this state, the connection of the two housings 10, 30 proceeds by the engagement of a cam groove (not shown) formed in the lever 50 and a cam follower (not shown) formed on the first housing 10. Along with this, the front end part of the plate 51 of the lever 50 enters the accommodation space 39 and the first pressing portion 55 presses the projection 38 of the resilient deflecting portion 37 from above. Thus, as shown in FIG. 5, the resilient deflecting portion 37 is displaced resiliently from the standby position to the operating position below and the lower surface of the resilient deflecting portion 37 presses the pressure receiving portion 63 of the resilient contact piece 62 from above. By this pressing, the resilient contact piece 62 is displaced resiliently to a retracted position below and the contact points 65 are separated from the covering portions 67. At this time, since the contact surfaces 21 are kept in contact with the wiping portions 68, the detection terminals 13 are shorted.

If the lever 50 is rotated further to proceed with the connection of the two housings 10, 30 from this state, the contact surfaces 21 pass over the wiping portions 68 and the wiping portion insulating layer 17 contacts the wiping portions 68. That is, the wiping portion insulating layer 17 is interposed between the detection terminals 13 and the wiping portions 68. Further, the projecting ends of the detection terminals 13 (projecting portions 14) slip under the covering portions 67, but the covering portion insulating layer 19 is interposed between the detection terminals 13 and the covering portions 67.

Further, the contact surfaces 21 of the detection terminals 13 reach positions corresponding to the contact points 65 of the resilient contact piece 62. However, since the second pressing portion 56 of the lock arm 53 presses the resilient deflecting portion 37 down and the resilient contact piece 62 is maintained in a state resiliently deflected down by this resilient deflecting portion 37, the contact points 65 do not contact the contact surfaces 21. Thus, the detection terminals 13 are kept in a short-circuit released state.

If the lever 50 is rotated farther to proceed with the connection of the two housings 10, 30 from this state and the two housings 10, 30 reach a state immediately before proper connection, the lock projection 54 interferes with the locking portion 40 and the lock arm 53 is displaced resiliently from the locking position to the unlocking position below as shown in FIG. 6. At this time, since the projection 38 corresponds to the upwardly retracted escaping portion 57 of the second pressing portion 56, the resilient contact piece 62 is kept at the retracted position without being excessively deflected and the contact points 65 are not in contact with the contact surfaces 21. Thus, the two detection terminals 13 are kept in the short-circuit released state. Therefore, it is judged that the two housings 10, 30 are not properly connected.

If the lever 50 reaches the connection position and the two housings 10, 30 are connected properly, the lock arm 53 resiliently returns from the unlocking position to the locking position, the lock projection 54 is locked to the locking portion 40 and the two housings 10, 30 are locked in the properly connected state, as shown in FIG. 7. Further, as the lock arm 53 resiliently returns, the projection 38 is released from the pressed state by the second pressing portion 56 of the lock arm 53. Thus, the resilient deflecting portion 37 resiliently returns to a short-circuit position from a short-circuit released position. In this way, the resilient contact piece 62 also is displaced resiliently up from the retracted position to a short-circuit position and the contact points 65 resiliently contact the contact surfaces 21. In this way, the detection terminals 13 are shorted via the shorting terminal fitting 60 and it is detected that the two housings 10, 30 are connected properly.

The connector of this embodiment includes the first housing 10 with the two detection terminals 13 and the second housing 30 connectable to the first housing 10. The second housing 30 is formed with the resilient deflecting portion 37 configured to be resiliently deflected in the connecting process of the two housings 10, 30 and resiliently return when the two housings 10, 30 are connected properly. The second housing 30 is provided with the shorting terminal fitting 60. The shorting terminal fitting 60 is formed integrally with the wiping portions 68 and the resilient contact piece 62. The detection terminals 13 slide in contact with the wiping portions 68 in the connecting process of the two housings 10, 30. The resilient contact piece 62 is displaced resiliently to the retracted position, where the resilient contact piece 62 is not in contact with the detection terminals 13, as the resilient deflecting portion 37 is resiliently deflected, and resiliently returns to the short-circuit position, where the resilient contact piece 62 is in contact with the detection terminals 13, and shorts the detection terminals 13 as the resilient deflecting portion 37 resiliently returns.

According to the connector thus configured, in the connecting process of the two housings 10, 30, even if external matter adheres to the contact surfaces 21 of the pair of detection terminals 13 to be brought into contact with the resilient contact piece 62, the external matter is removed by the sliding contact of the contact surfaces 21 with the wiping portions 68. This can prevent the external matter from being caught between the detection terminals 13 and the resilient contact piece 62. Since the wiping portions 68 and the resilient contact piece 62 are formed integrally in the shorting terminal fitting 60, a reduction in the number of components is realized as compared to the case where the wiping portions 68 and the resilient contact piece 62 are separate components.

Further, the detection terminals 13 are provided with the wiping portion insulating layer 17 made of synthetic resin and configured to be interposed between the detection terminals 13 and the wiping portions 68 immediately before the two housings 10, 30 are connected properly. According to this configuration, since the detection terminals 13 and the wiping portions 68 are held out of contact by the wiping portion insulating layer 17 immediately before the two housings 10, 30 are connected properly, the detection terminals 13 are not shorted via the wiping portions 68. Thus, whether or not the two housings 10, 30 have been connected properly can be detected reliably.

Further, the two detection terminals 13 are provided with the wiping portion side extension layer 18 extending straight in parallel to the connecting direction of the two housings 10, 30 and formed by extending the wiping portion insulating layer 17 toward the base end sides of the detection terminals 13 (toward the terminal holding portion 11). The wiping portion side positioning rib 36 for positioning the detection terminals 13 by causing the wiping portion insulating layer 17 and the wiping portion side extension layer 18 to slide in contact therewith is formed at the entrance opening 34 which is open in the front surface of the second housing 30 and through which the detection terminals 13 are inserted. According to this configuration, a contact state of the resilient contact piece 62 and the detection terminals 13 is stabilized by positioning the detection terminals 13.

Further, the detection terminals 13 are united via the coupling 15 made of synthetic resin, and the wiping portion insulating layer 17 is connected to the coupling 15 and continuous over the detection terminals 13. According to this configuration, since the detection terminals 13 are coupled via the coupling 15 and the wiping portion insulating layer 17, a mutual positional relationship of the detection terminals 13 is stabilized.

The shorting terminal fitting 60 is formed integrally formed with the covering portions 67 for covering the contact points 65 of the resilient contact piece 62 with the detection terminals 13 in the state where the two housings 10, 30 are not connected yet. According to this configuration, the adhesion of external matter to the contact points 65 of the resilient contact piece 62 can be prevented. In addition, since the contact points 65 are resiliently in contact with the covering portions 67 in the state where the two housings 10, 30 are not connected yet, the adhesion of external matter to the contact points 65 can be prevented more reliably.

The detection terminals 13 are provided with the covering portion insulating layer 19 made of synthetic resin and configured to be interposed between the two detection terminals 13 and the covering portions 67 immediately before the two housings 10, 30 are connected properly. According to this configuration, since the detection terminals 13 and the covering portions 67 are held out of contact by the covering portion insulating layer 19 immediately before the two housings 10, 30 are connected properly, the detection terminals 13 are not shorted via the covering portions 67. Thus, whether or not the two housings 10, 30 have been connected properly can be detected reliably.

The detection terminals 13 are provided with the covering portion side extension layer 20 extending straight in parallel to the connecting direction of the two housings 10, 30 and formed by extending the covering portion insulating layer 19 toward the base end sides of the detection terminals 13 (toward the terminal holding portion 11). The covering portion side positioning ribs 35 for positioning the pair of detection terminals 13 by causing the covering portion insulating layer 19 and the covering portion side extension layer 20 to slide in contact therewith are formed at the entrance opening 34 that is open in the front surface of the second housing 30 and through which the detection terminals 13 are inserted. According to this configuration, the contact state of the resilient contact piece 62 and the detection terminals 13 is stabilized by positioning the detection terminals 13.

The two detection terminals 13 are united via the coupling portion 15 made of synthetic resin, and the covering portion insulating layer 19 is connected to the coupling 15 and continuous over the detection terminals 13 in a width direction (lateral direction). According to this configuration, since the detection terminals 13 are coupled via the coupling portion 15 and the covering portion insulating layer 19, the mutual positional relationship of the detection terminals 13 is stabilized.

The invention is not limited to the above described and illustrated embodiment. For example, the following embodiments also are included in the scope of the invention.

Although the resilient contact piece is provided with the two arms configured to individually contact the two detection terminals in the above embodiment, the resilient contact piece may be in the form of an entirely wide single plate including areas configured to contact the detection terminals.

Although the two wiping portions are provided in the above embodiment, a wiping portion in the form of a wide single plate may be employed.

Although the contact points of the resilient contact piece come into contact with the covering portions in the state where the two housings are not connected yet in the above embodiment, the contact points of the resilient contact piece and the covering portions may be out of contact in the state where the two housings are not connected yet.

Although the shorting terminal fitting is formed with the covering portions for covering the contact points of the resilient contact piece in the above embodiment, such covering portions may be not formed.

Although the wiping portion insulating layer is provided on both of the pair of detection terminals in the above embodiment, the wiping portion insulating layer may be provided only on either one of the pair of detection terminals.

In the above embodiment, the wiping portion insulating layer is provided as a means for preventing the detection terminals from being shorted via the covering portions since the detection terminals extend straight in parallel to the connecting direction of the two housings. However, the wiping portion insulating layer may not be provided if the detection terminals are bent and there is no possibility that the detection terminals are shorted via the wiping portions immediately before the two housings are properly connected.

Although the covering portion insulating layer is provided on both of the detection terminals in the above embodiment, the covering portion insulating layer may be provided only on either one of the detection terminals.

Although the covering portion insulating layer is provided for preventing the detection terminals from being shorted via the covering portions in the above embodiment, the covering portion insulating layer may not be provided if the covering portions are not provided.

Although the wiping portion side extension layer provided on the detection terminals is caused to slide in contact with the wiping portion side positioning rib in the above embodiment, the wiping portion side extension layer and the wiping portion side positioning rib may not be provided.

Although the covering portion side extension layer provided on the detection terminals is caused to slide in contact with the covering portion side positioning ribs in the above embodiment, the covering portion side extension layer and the covering portion side positioning ribs may not be provided.

Although the detection terminals are united via the coupling portion in the above embodiment, such a coupling portion may not be provided.

Although the dedicated resilient deflecting portion as a connection detection means is provided separately from the lock arm for locking the two housings in the connected state in the above embodiment, the lock arm may have the function of the resilient deflecting portion as the connection detection means.

Although the first and second housings are connected using the lever in the above embodiment, the invention can be applied also in the case of connecting the first and second housings without using any lever.

LIST OF REFERENCE SIGNS

10 . . . first housing
13 . . . detection terminal
15 . . . coupling portion
17 . . . wiping portion insulating layer
18 . . . wiping portion side extension layer
19 . . . covering portion insulating layer
20 . . . covering portion side extension layer
30 . . . second housing
34 . . . entrance opening
35 . . . covering portion side positioning rib
36 . . . wiping portion side positioning rib
37 . . . resilient deflecting portion
60 . . . shorting terminal fitting
62 . . . resilient contact piece
65 . . . contact point
67 . . . covering portion
68 . . . wiping portion

The invention claimed is:

1. A connector, comprising:

a first housing;

a second housing having a front end that is connectable to the first housing along a connecting direction;

a resilient deflecting portion formed in the second housing and configured to be resiliently deflected in the process of connecting the first and second housings and resiliently return when the first and second housings are properly connected;

two detection terminals mounted in the first housing and projecting parallel to the connecting direction, each of the detection terminals having a front end and an exposed contact surface on a lower surface of each of the detection terminals, the exposed contact surfaces extending rearward from the front end of the respective detection terminals, areas of the lower surface of each of the detection terminals rearward of the exposed contact surface being covered by a wiping portion insulation layer of the first housing;

a shorting terminal fitting provided in the second housing;

a resilient contact piece integral with the shorting terminal fitting and configured to be displaced resiliently to a retracted position where the resilient contact piece is not in contact with the detection terminals as the resilient deflecting portion is resiliently deflected, and further configured to return resiliently to a short-circuit position, where the resilient contact piece is in contact with the contact surfaces of the detection terminals, and to short the detection terminals as the resilient deflecting portion resiliently returns; and a wiping portion integral with the shorting terminal fitting at a position between the resilient contact piece and the front end of the second housing, the wiping portion being configured to slide in contact with the contact surfaces of the detection terminals while connecting the first and second housings and before the resilient contact piece contacts the contact surfaces of the detection terminals.

2. The connector of claim 1, wherein the wiping portion insulating layer provided on the detection terminal is configured to be interposed between the detection terminal and the wiping portion immediately before the first and second housings are properly connected.

3. A connector, comprising:

a first housing having a front end;

a second housing having a front end that is connectable to the front end of the first housing along a connecting direction;

a resilient deflecting portion formed in the second housing and configured to be deflected resiliently in the process of connecting the first and second housings and to return resiliently when the first and second housings are connected properly;

a shorting terminal fitting provided in the second housing;

two detection terminals projecting in the first housing and extending straight in parallel to the connecting direction of the first and second housings, each of the detection terminals being provided with a contact surface extending along a side surface of each of the detection terminals at a position in proximity to the front end of the first housing and a wiping portion insulating layer extending along the side surface of each of the detection terminals from the contact surface toward base end sides of the detection terminals; and a wiping portion side positioning rib formed at an entrance opening in the front surface of the second housing through which the detection terminals are inserted and configured to position the detection terminals by causing the wiping portion insulating layer to slide in contact therewith.

4. The connector of claim 3, wherein:

the detection terminals are united via a coupling made of synthetic resin; and the wiping portion insulating layer is connected to the coupling portion and continuous over the pair of detection terminals.

5. A connector, comprising:

a first housing having a front end;

a second housing having a front end that is connectable to the front end of the first housing along a connecting direction;

a resilient deflecting portion formed in the second housing and configured to be deflected resiliently in the process of connecting the first and second housings and to return resiliently when the first and second housings are connected properly;

two detection terminals projecting in the first housing parallel to the connecting direction, each of the detection terminals having a contact surface;

a shorting terminal fitting provided in the second housing, the shorting terminal including:

a resilient contact piece integral with the shorting terminal fitting and configured to be displaced resiliently to a retracted position where the resilient contact piece is not in contact with the detection terminals, as the resilient deflecting portion is resiliently deflected and further configured to return resiliently to a short-circuit position, where the resilient contact piece is in contact with the contact surfaces of the detection terminals and to short the detection terminals as the resilient deflecting portion resiliently turns, a wiping portion integrally with the shorting terminal fitting at a position between the resilient contact piece and the front end of the second housing and configured to slide in contact with the contact surfaces of the detection terminals while connecting the first and second housings and before the resilient contact piece contacts the contact surfaces of the detection terminals, and a covering portion integrally formed to the shorting terminal fitting and configured to cover contact points of the resilient contact piece with the detection terminals in a state where the first and second housings are not connected yet.

6. The connector of claim 5, wherein the contact points resiliently come into contact with the covering portion in the state where the first and second housings are not connected yet.

7. The connector of claim 5, comprising a covering portion insulating layer provided on the detection terminal and configured to be interposed between the detection terminal and the covering portion immediately before the first and second housings are properly connected.

8. The connector of claim 7, wherein:

the detection terminals extend straight in parallel to a connecting direction of the first and second housings;

the detection terminals are provided with a covering portion side extension layer formed by extending the covering portion insulating layer toward base end sides of the detection terminals; and a covering portion side positioning rib configured to position the detection terminals by causing the covering portion insulating layer and the covering portion side extension layer to slide in contact therewith is formed at an entrance opening that is open in a front surface of the second housing and through which the detection terminals are inserted.

9. The connector of claim 8, wherein:

the detection terminals are united via a coupling portion made of synthetic resin; and the covering portion insulating layer is connected to the coupling and continuous over the pair of detection terminals.

10. The connector of claim 1, wherein the shorting terminal further comprises a base plate, the resilient contact piece extending integrally from an end of the base plate and two bilaterally symmetrical side walls rising from opposite left and right sides of the base plate and disposed laterally on opposite respective sides of the resilient contact piece.

* * * * *